United States Patent [19]

Furumoto et al.

[11] 4,408,593

[45] Oct. 11, 1983

[54] LIQUID FUEL COMBUSTION APPARATUS

[75] Inventors: Michitake Furumoto; Shinichi Harada, both of Tokyo, Japan

[73] Assignee: Nippon Carbureter Co., Ltd., Tokyo, Japan

[21] Appl. No.: 382,673

[22] Filed: May 27, 1982

[51] Int. Cl.[3] ..... F24C 5/00; F23D 11/44

[52] U.S. Cl. ..... 126/85 R; 126/93; 431/232

[58] Field of Search ..... 126/85 R, 93, 95, 350 B, 126/116 A; 431/161, 162, 207, 216, 218, 220, 221, 222, 231, 232, 235, 247

[56] References Cited

U.S. PATENT DOCUMENTS

| | | | |
|---|---|---|---|
| 1,320,930 | 11/1919 | Rusteberg | 431/232 |
| 1,633,175 | 6/1927 | Gieseke | 431/232 |
| 1,747,613 | 2/1930 | Baetz | 431/232 |
| 2,538,492 | 1/1951 | Anderson | 126/93 |
| 2,674,239 | 4/1954 | Lundberg | 126/93 |
| 2,826,190 | 3/1958 | Hancock | 126/93 |
| 3,306,337 | 2/1967 | Martin | 431/232 |
| 3,308,868 | 3/1967 | Reichhelm | 431/232 |
| 3,397,028 | 8/1968 | Brauer | 431/216 |
| 3,437,086 | 4/1969 | Phillip | 126/93 |
| 3,570,828 | 3/1971 | Cowan | 431/232 |

*Primary Examiner*—Daniel J. O'Connor
*Attorney, Agent, or Firm*—Hammond & Littell, Weissenberger and Muserlian

[57] ABSTRACT

This invention relates to a liquid fuel combustion apparatus such as oil space heater in which liquid fuel is vaporized by a vaporizer and the vaporized liquid fuel is injected through a first nozzle to a burner. The vaporizer is heated by combustion of fuel gas which is injected through a second nozzle to the burner before the vaporizer has been heated up to a temperature at which the liquid fuel passing the vaporizer is evaporated. The injection of the fuel gas from the second nozzle to the burner is changed to the injection of the vaporized liquid fuel from the first nozzle when the vaporizer has been heated up to a desired temperature. The supply of the liquid fuel to the vaporizer is carried out by a fuel pump which is driven by electric power generated by a thermopile.

7 Claims, 7 Drawing Figures

LIQUID FUEL COMBUSTION APPARATUS

BACKGROUND OF THE INVENTION

This invention relates to a liquid fuel combustion apparatus and, more particularly to an oil space heater.

In a liquid fuel combustion apparatus in which combustion of oil such as a relatively light fuel oil or kerosene is taken place at a burner, the liquid fuel is atomized into many very small oil drops or vaporized by contacting it with a hot member, and atomized or vaporized liquid fuel is supply to the burner.

In the liquid fuel combustion apparatus of the type of vaporization combustion, evaporation of liquid fuel is carried out by means of a vaporizer which is heated by an electrical heater or combustion of alcohol fuel.

It is a great convenience to heat the vaporizer with electricity. It takes, however, considerable times for heating up the vaporizer to a desired temperature by means of electric heating means or coils.

Further, it has disadvantages that liquid fuel is impossible to supply to the vaporizer for evaporating it before the vaporizer has been heated up to a desired temperature.

It is necessary to use the electric power from an outer power supply to heat the vaporizer electrically and to drive electrically a fuel pump to feed the vaporized liquid fuel to the burner. In the apparatus of this type, therefore, it requires to provide electrical circuit and to consider electric connections with respect to an outer power supply.

OBJECTS OF THE INVENTION

It is therefore the chief object of the invention to provide a liquid fuel combustion apparatus or oil space heater in which at the start of operation of the apparatus fuel gas is burnt at a burner whose heat is directed to heat a vaporizer.

It is another object of the present invention to provide a liquid fuel combustion apparatus in which when the vaporizer has been heated up to a desired temperature, supply of fuel gas to the burner is stopped and supply of liquid fuel is taken place.

It is a further object of the present invention to provide a liquid fuel combustion apparatus in which supply to liquid fuel from a fuel tank to the burner through the vaporizer is carried out by a fuel pump which is driven by electricity.

It is a still further object of the present invention to provide a liquid fuel combustion apparatus including the fuel pump which is driven by electricity without using an outer power source.

It is an additional object of the present invention to provide a liquid fuel combustion apparatus including a thermoelectric generator or thermopile.

It is a further object of the present invention provide to a liquid fuel combustion apparatus or oil space heater which is capable of heating the space at about the same time as the start of operation of the apparatus.

BRIEF DESCRIPTION OF THE DRAWINGS

The above and other related objects and features of the present invention will be readily appreciated as the apparatus becomes better understood by reference to the following detailed description when considered in connection with the accompanying drawings, in which.

DESCRIPTION OF THE PREFERRED EMBODIMENTS

Figure 1:
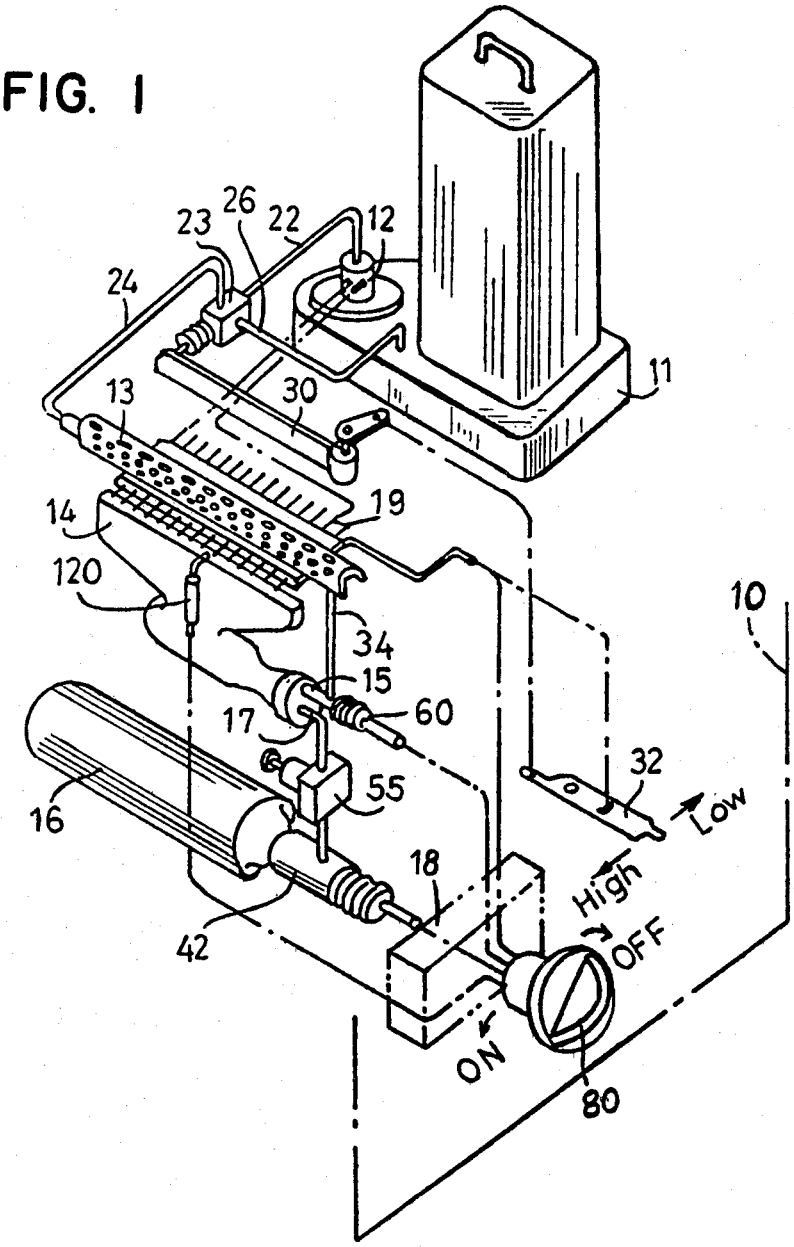
FIG. 1 is a schematic illustration in perspective of a preferred embodiment of the present invention.
Figure 2:
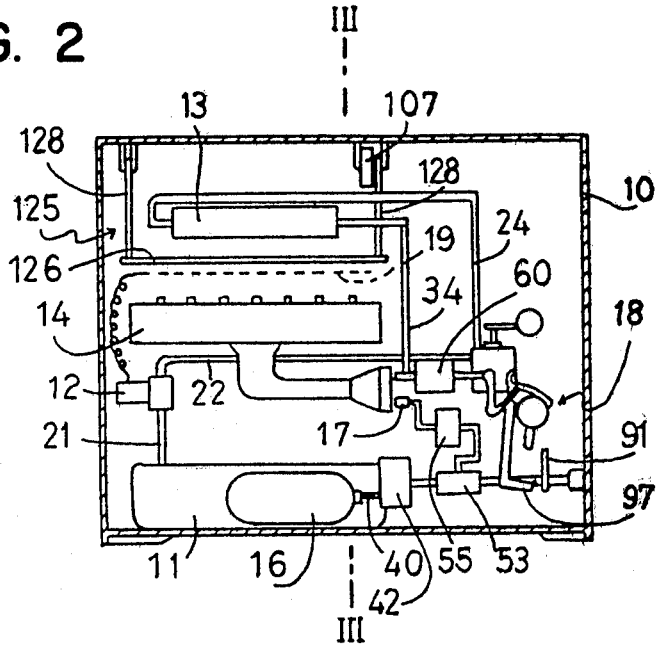
FIG. 2 is an elevational view showing main elements of the present invention.
Figure 3:
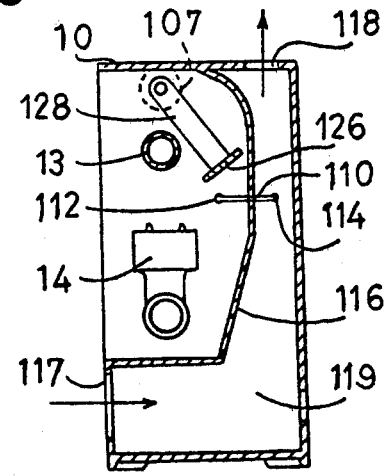
FIG. 3 is a cross section taken substantially on line III—III of FIG. 2.

Referring now in detail to FIGS. 1 to 4, a liquid fuel combustion apparatus or oil space heater of the invention includes a housing 10, a tank 11 of liquid fuel such as, for example, kerosene, a liquid fuel pump 12, a vaporizer 13 for evaporating liquid fuel, a burner 14, a first injection nozzle 15 for ejecting the vaporized liquid fuel to the burner 14, a fuel gas supply source 16, a second injection nozzle 17 for ejecting the fuel gas to the burner 14, a change-over means for converting injection of the fuel gas from the second injection nozzle 17 to injection of the vaporized liquid fuel from the first injection nozzle 15 and means 19 for generating electric power for driving the fuel pump 12.

The fuel tank 11 is communicated through a conduit 21 with the fuel pump 12 which may be driven by electricity, and the liquid fuel in the tank 11 may be fed to the vaporizer 13 through a conduit 22, a fuel regulator 23 and a conduit 24.

Figure 4:
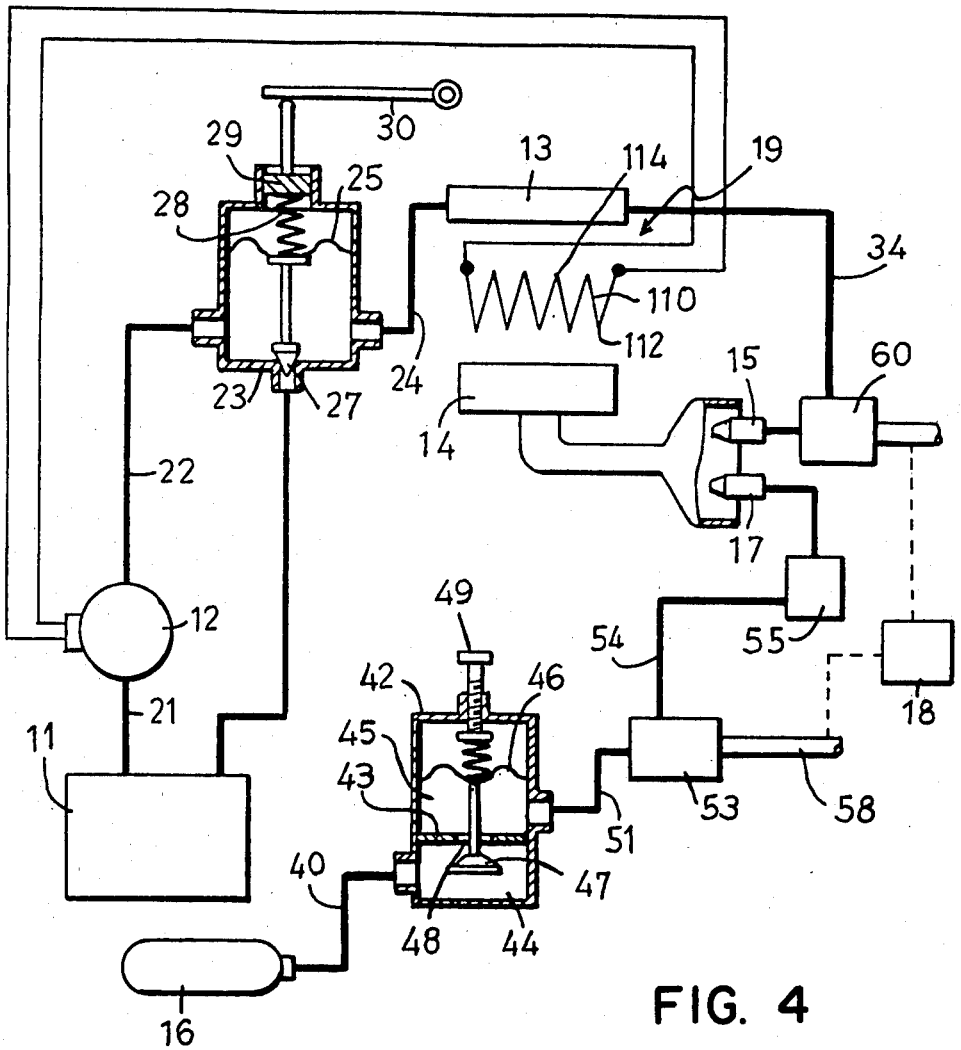
FIG. 4 is a schematic diagram showing fuel passages of the present invention.

As shown in FIG. 4, the fuel regulator 23 may be of a diaphragm valve a side wall of which is formed by a diaphragm 25. A conduit 26 is connected to a side wall opposite to the diaphragm 25 and is provided with a valve 27 operated by the diaphragm 25. The conduit 26 is communicated with the liquid fuel tank 11.

The diaphragm 25 is operatively connected through a coil spring 28, a spring bearing member 29 and link mechanisms 30 with a temperature control lever 32 which is extended outwardly through the housing 10 to manipulate. In operation of the oil space heater of the present invention, when the temperature control lever 32 has been manipulated to a "high temperature side", the diaphragm 25 is impressed thereby and the conduit 26 is closed by the valve 27 for supplying the liquid fuel pumped by the fuel pump 12 to the vaporizer 13 through the fuel regulator 23 and the conduit 24. On the other hand, when the temperature control lever 32 has been manipulated to a "low temperature side", a portion of the liquid fuel entered into the fuel regulator 23 is returned to the fuel tank 11 through the conduit 26, and the amount of the liquid fuel to be supplied to the vaporizer 13 is reduced.

The vaporizer 13 serves to heat and evaporate or gasify the liquid fuel passing therethrough and the vaporized liquid fuel is fed through a conduit 34 to the first nozzle 15. To heat the vaporizer 13 with combustion of fuel at the burner 14, the vaporizer 13 is arranged above the burner 14 in the housing 10.

According to the present invention, in the case that the vaporizer 13 is cooled not enough to heat the liquid fuel passing therethrough at the start of operation of the oil space heater, the vaporizer 13 is heated by combustion of fuel gas at the burner 14. For this purpose, the burner 14 has the second nozzle 17 for injecting fuel gas such as propane or town gas to the burner. In the present invention, it is desirable to make use of liquified petroleum gas, and the source of the fuel gas 16 may be a liquified propane gas container or vessel. The fuel gas source 16 is communicated through a conduit 40 with a gas regulator 42.

As it is shown in FIG. 4, the gas regulator 42 may be a diaphragm valve means, the casing of which is separated by a partition 43 to form two chamber 44 and 45. The partition 43 has an opening 48 therein with a valve 47 which may be operated by the diaphragm 46. It is possible to provide a suitable adjusting means 49 for controlling the operation of the valve 47.

Figure 5:
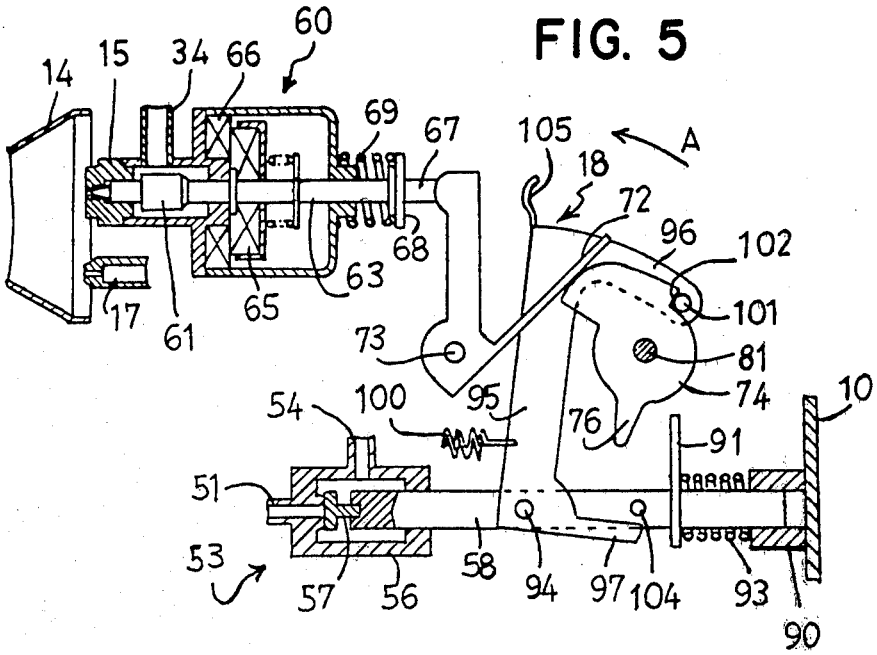
FIGS. 5, 6 and 7 are schematic cross-sectional views illustrating operation of a change-over means of a liquid fuel valve and a fuel gas valve.

As shown in FIG. 5, the chamber 45 of the gas regulator 42 is communicated through a conduit 51 with a valve means 53 which may control the supply of the fuel gas to the second nozzle 17 from the fuel gas container 16 through a conduit 54 and a gas reservoir 55 and consists of a casing 56, valve member 57 and a valve stem or rod 58 for operating the valve member 57.

The first nozzle 15 which opens at the inlet of the burner 14 is provided with a valve means 60 as shown in FIG. 5. The valve means 60 is closed before the temperature of the vaporizer 13 has been reached a desired range for atomizing or evaporating the liquid fuel passing therethrough, while the vaporizer 13 has been heated good enough to atomize or evaporate the liquid fuel, the valve means 60 is opened to inject the fuel from the first nozzle 15. For this purpose, the valve means 60 has a valve 61 and a valve rod 63 separated from the valve 61. The valve rod 63 is mounted on the valve means 60 so as to slide in a longitudinal axis of the rod. A permanent magnet 65, the magnetic property of which is not effected by heating, is fixed to the valve rod 63 so as to cooperate with a ferro-magnetic member 66 arranged in the valve means 60. The ferro-magnetic member is of the substance such as, for example, ferrite which has a certain Curie point so as to reduce magnetic force when it has been heated.

One of the ends of the valve rod 63 is arranged to contact with the valve 61 and a disc 68 is fixed to the other end 67 of the rod. The valve means 60 is constructed in the manner that the first nozzle 15 may be opened to inject the vaporized liquid fuel by disengaging the valve 61 from the valve rod 63 by means of a coil spring 69 mounted on the valve rod 63 between the outer wall of the valve means 60 and the disc 68.

Figure 6:
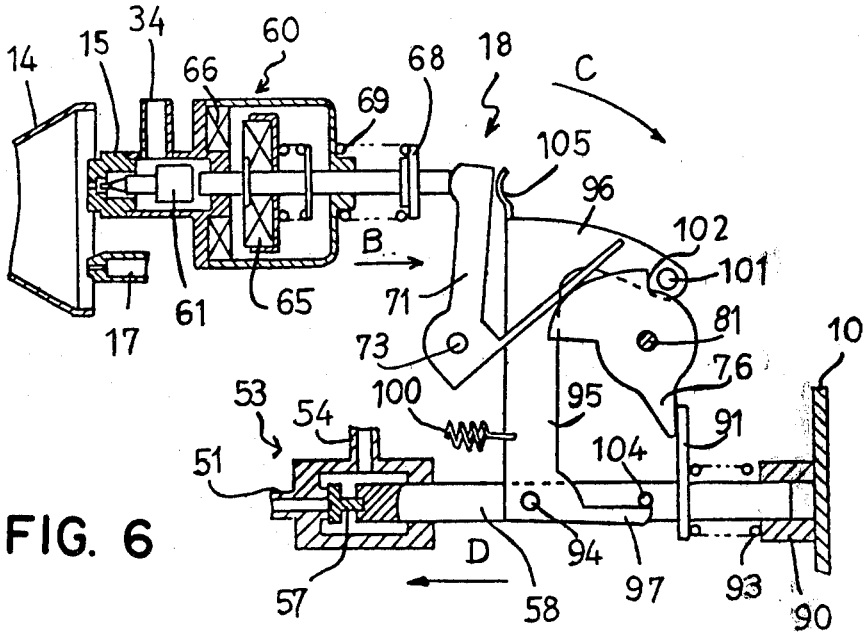
Figure 7:
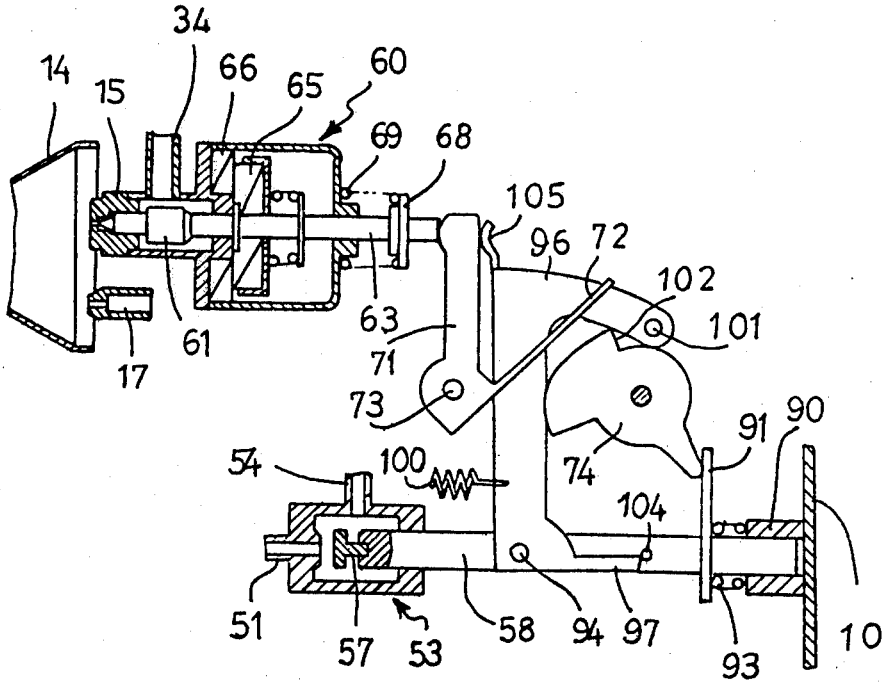

As it is clearly shown in FIGS. 5 through 7, the operation of the valve means 60 for the first nozzle 15 may be cooperated with the operation of the valve means 53 by means of the change-over mechanisms 18.

The change-over mechanisms 18 include a V-shape lever having arms 71 and 72 for actuating the valve rod 63 of the valve means 60. The V-shape lever is mounted on the housing 10 to rotate about a pin 73 which is attached to a connected portion of both arms 71 and 72.

An on-off knob 80 is mounted on a shaft 81 to be manipulated in the front of the housing 10. A cam plate 74 is mounted on the shaft 81 so as to rotate with it.

When the on-off knob 80 has been put into the "off" position, the arm 72 of the V-shape lever is contacted with the periphery of the cam plate 74, the valve rod 63 is pressed to close the valve 61, and the permanent magnet 65 of the valve means 60 attracts the ferro-magnetic member 66 mounted on the valve rod 63 to fix each other. It is preferable that the contour of the cam plate 74 is formed to contact with the arm 72 of the V-shape lever in a desired angle of rotation of the on-off knob 80 from the "off" position to the "on" position, and the arm 72 is released from the cam plate 74 in further rotation of the knob 80.

The valve rod 58 of the valve means 53 is slidably supported on a bearing member 90 mounted on the housing 10. The valve rod 58 has an upright member 91 and a coil spring 93 is mounted thereon between the upright member 91 and the bearing member 90. In the "off" position of the knob 80 the valve means 53 is closed by the valve rod 53 under the pressure of the coil spring 93.

A U-shape lever which is formed from arms 95, 96 and 97 is pivotably mounted on the valve rod 58. A spring 100 is arranged between the arm 95 and the housing 10 to pull the arm 95 to the direction shown in an arrow A. At an end of the arm 96, a pin 101 is provided to engage with a notch 102 of the cam plate 74 when the on-off knob 80 has been put in the "off" position.

The arm 97 of the U-shape lever extends along a longitudinal axis of the valve rod 58 and a free end of the arm 97 is operatively connected to a pin 104 provided with the valve rod 58. As shown in FIG. 5, a free end of the arm 97 is disengaged with the pin 104 when the on-off knob 80 has been set in the "off" position.

When the knob 80 has been moved to set in the "on" position, an automatic ignition device 120 such as a pilot burner (FIG. 1) which is wellknown per se and arranged to be operated by otation of the shaft 81 may ignit the fuel at the burner 14.

When the knob 80 has been set in the "on" position, the pin 101 of the arm 96 of the U-shape lever disengages with the notch 102 of the cam plate 74, as shown in FIG. 6. Then the arm 95 is pulled in the direction of the arrow A by means of the spring 100, and stopped in contact of an upper end 105 of the arm 95 with the arm 71 of the V-shape lever.

When the knob 80 has been turned to the "on" position from the "off" position, a protruded portion of the cam plate 74 contacts with the upright member 91 fixed to the valve rod 58 and then the portion 76 is forced against the coil spring 93 to move the valve rod 58 for opening the valve means 53. Thus the gas of the fuel gas supply 16 is injected into the burner 14 from the second nozzle 17 through the conduit 40, gas regulator 42, conduit 51, valve means 53, conduit 54 and gas reservoir 55, and may be fired at the burner 14 by means of the automatic ignition device 120.

Combustion of the gat at the burner 14 heats the vaporizer 13 and after having been lapsed a certain time the vaporizer 13 may be heated good enough to evaporate the liquid fule passing therethrough.

At this time it is necessary to operate the fuel pump 12 to feed the liquid fuel from the tank 11 to the vaporizer 13.

According to the present invention, the thermoelectric generator 19 is provided for produce electrical energy for driving or operating the fuel pump 12. As shown in FIG. 4, the generator 19 is of a thermopile which consists of a number of thermocouples 110 which are arranged in series, with alternate hot junction 112 and cold junction 114. The hot junctions 112 are arranged adjacent to the burner 13 and the cold junctions 114 shall be arranged at a low temperature space in the housing 10.

For this purpose, the housing 10 may be divided by a partition 116 and the vaporizer 13 and the burner 14 are respectively positioned in front of the partition 116. The housing 10 has an air inlet 117 at the lower part and an air outlet 118 at the upper part thereof to pass the air from the outside of housing 10 through the space 119 at the back of the partition 116 to the outlet 117.

The hot junctions 112 of the thermopile are arranged in front of the partition 116, while the cold junctions 114 are arranged in the space 119.

The thermopile 19 may be consisted of, for example, chromel-constantan thermocouple.

In our experiments, it is possible to obtain about 1 kW of electric power by using about 20 thermocouples of diameter of about 1.2~1.6 mm and length of about 35~70 mm.

When the vaporizer 13 has been heated to a desired temperature to evaporate liquid fuel passing therethrough, the ferro-magnetic member 66 disposed in the valve means 60 will also heated to reduce its magnetic force, and the valve rod 63 will be moved in a direction of arrow B as shown in FIG. 6 by means of the coil spring 69. Accordingly, the vaporized liquid fuel of the vaporizer 13 is injectied from the first nozzle 15 into the burner 14 passing through the conduit 34 and the valve means 60.

The movement of the valve rod 63 in the direction of the arrow B to open the valve means 60 rotates the arm 71 of the U-shape lever about the pin 73 in the direction of an arrow C. Thus the free end of the arm 97 disengages with the pin 104 of the valve rod 58, and the valve rod 58 is moved by the action of the spring 93 in the direction of an arrow D to close the valve means 53 for preventing the injection of gas fuel from the second nozzle 17 into the burner 14.

In combustion of gas fuel in the oil space heater of the present invention, if the on-off knob 80 is manipulated to the "off" position, the cam plate 74 will be rotated by the shaft 81 to engage the pin 101 of the arm 96 of the U-shape lever with the notch 102 in the cam plate 74, the arm 95 of the U-shape lever will be rotated against the force of the spring 100 to disengage the arm 97 with the pin 104 of the valve rod 58, and the valve rod 58 will be forced by the action of the spring 93 so as to close the valve means 53 for gas fuel.

On the other hand, in combustion of the vaporized liquid fuel in the oil space heater of the present invention, if the on-off knob 80 is manipulated to the "off" position, the arms 71 and 72 of the U-shape lever will turned about the pin 73, and the valve rod 63 of the valve means 60 will be pushed against the force of the coil spring 69 to close the valve means 60.

In the present invention it is desirable to provide means for preventing overheat 125 of the vaporizer 13.

The overheat preventing means 125 includes a heat shelter 126 which is arranged between the vaporizer 13 and the burner 14. The heat shelter 126 may be supported by supportion arms 128 so as to be rotated by a pivotting device 127 disposed on the inner wall of the housing 10. The pivotting device 127 is operationally cooperated with a heat-response means 107 including bimetallic strips or spring bellows which operate with the temperature and cause the pivotting device 127 to deflect. The heat shelter 126 is positioning at between the vaporizer 13 and the burner 14 at the normal temperature, while the temperature of the vaporizer 13 has been rised over a temperature range at which the vaporizer 13 is overheated, the heat shelter 126 is inserted into between the vaporizer 13 and the burner 14.

While the prefered embodiment of the present invention has been described, it is to be understood that modifications will be apparent to those skilled in the art without departing from the spirit and scope of the invention.

What we claim is:

1. A liquid fuel combustion apparatus comprising a housing, a liquid fuel tank to be disposed in said housing, a vaporizer for evaporating the liquid fuel supplied thereto from said fuel tank, a liquid fuel pump for supplying the liquid fuel from said fuel tank, a burner for burning the vaporized liquid fuel in passing through said vaporizer, a first nozzle for injecting the vaporized liquid fuel into said burner, a fuel conduit communicating said vaporizer with said first nozzle, a first valve means provided in said conduit, a fuel gas supply source, a second nozzle for injecting the fuel gas of said fuel gas supply source, a fuel gas conduit communicating said fuel gas supply source with said second nozzle, a second valve means provided in said fuel gas conduit, means for changing the operation of said first valve means and the operation of said second valve means, and a thermo-electric generator for producing electric energy for operating said fuel pump when said vaporizer has been heated by the fuel gas to a desired temperature.

2. A liquid fuel combustion apparatus claimed in claim 1 in which said changing means has been manipulated by an "on-off" knob.

3. A liquid fuel combustion apparatus claimed in claim 1 in which said second valve means is operated to pass the fuel gas by said changing means when said "on-off" knob has been manipulated from "off" position to "on" position.

4. A liquid fuel combustion apparatus claimed in claim 1 in which said first valve means is operated to pass the liquid fuel and said second valve means is operated to close the fuel gas conduit when said vaporizer has been heated up to a desired temperature range.

5. A liquid fuel combustion apparatus claimed in claim 1 in which said thermo-electric generator is a thermopile.

6. A liquid fuel combustion apparatus claimed in claim 1 in which an overheat preventing means is provided to protect said vaporizer.

7. A liquid fuel combustion apparatus claimed in claim 1 in which said overheat preventing means is operated in response to the change of temperature in said housing.

* * * * *